US005380217A

United States Patent [19]

Yagi et al.

[11] Patent Number: 5,380,217

[45] Date of Patent: Jan. 10, 1995

[54] CONNECTOR

[75] Inventors: Sakai Yagi; Keishi Jinno, both of Shizuoka, Japan

[73] Assignee: Yazaki Corporation, Tokyo, Japan

[21] Appl. No.: 118,244

[22] Filed: Sep. 9, 1993

[30] Foreign Application Priority Data

Sep. 9, 1992 [JP] Japan ..... 4-240496

[51] Int. Cl.[6] ..... H01R 13/627

[52] U.S. Cl. ..... 439/358; 439/350

[58] Field of Search ..... 439/345, 350, 352, 353, 439/354, 357, 372, 358

[56] References Cited

U.S. PATENT DOCUMENTS

| | | | |
|---|---|---|---|
| 4,200,350 | 4/1980 | Zimmerman, Jr. | 439/357 |
| 4,431,244 | 2/1984 | Anhalt et al. | 439/358 |
| 4,708,662 | 11/1987 | Klein | 439/353 |
| 4,915,643 | 4/1990 | Samejima et al. | 439/357 |

FOREIGN PATENT DOCUMENTS 136986 11/1989 Japan .

*Primary Examiner*—Khiem Nguyen

*Attorney, Agent, or Firm*—Sughrue, Mion, Zinn, Macpeak & Seas

[57] ABSTRACT

Disclosed is a connector for use in connecting a wire harness mainly for automobiles, and the object thereof is to provide a connector with improved locking stability and excellent operability and reliability. In the connector in which a male connector and a female connector are mutually held by a locking arm while inserting a casing body of the female connector into an annular space formed by arranging an outer casing in the male connector, the locking arm includes an arm body and a pushing section. The arm body extends frontward from a rising base portion continuously formed on the outer periphery of the male connector, and the pushing section extends rearward. The front end of the arm body is coupled integrally to the outer casing through a flexible coupling portion.

6 Claims, 3 Drawing Sheets

CONNECTOR

BACKGROUND OF THE INVENTION

1. Field of the Invention

The invention relates to a connector for use in connecting a wire harness mainly for automobiles.

2. Related Art

FIGS. 7 and 8 are diagrams illustrative of an example of a conventional watertight connector. Outside a male connector "a" is an outer casing "b" continuously arranged through a rear coupling wall "c". An annular accommodating space "s" is formed, and a seal ring "d" is arranged so as to face the annular accommodating space "s".

Within a bulge "$b_1$" of the outer casing is a cantilever-like flexible locking arm "e" arranged through an intermediate support portion "$e_2$", and a pushing section "$e_3$" extends rearward.

FIG. 8 shows a condition in which the male connector "a" is coupled to a counterpart female connector "f". Watertightness is ensured with a casing body "$f_1$" of the female connector f entering into the annular accommodating space "s" and abutting against the seal ring "d". At the same time, the female connector "f" receives the male connector "a" therein to allow their terminal fittings to be in contact with each other, thereby causing the holding portion "$e_1$" of the locking arm "e" to be engaged with a holding projection "g" formed on the casing body "$f_1$" of the female connector f (Japanese Utility Model Publication No. 36986/1989).

In this case, since the locking arm "e" is of the cantilever-like structure by the intermediate support portion "$e_2$", the front end of the locking arm "e" is liable to float at the time of molding or due to changes in ambient temperature. As a result, it is difficult to keep a strong locked condition, thus not ensuring reliability. If tensile force is applied to both connectors, the locked condition may be released.

SUMMARY OF THE INVENTION

The invention has been made in view of the above circumstances. Accordingly, the object of the invention is to provide a connector with improved locking stability as well as excellent operability and reliability.

To achieve the above object, the invention is applied to a connector in which an annular space is formed by arranging an outer casing in a male connector. A casing body of a female connector is inserted into the annular space. The male connector has an arm body and a pushing section, the arm body extending frontward through a rising base portion continuously formed on an outer periphery of the male connector, and the pushing section extending rearward. The arm body has a locking arm, which includes a holding portion to be engaged with the inserted female connector. In such a connector, a front end of the arm body of the locking arm is integrally coupled to the outer casing through a flexible coupling portion.

The connector of the invention is provided as supporting the arm body at two points, namely, the flexible coupling portion and the rising base portion, with flexible coupling portion integrally coupling the front end of the arm body of the locking arm to the outer casing of the connector and with the rising base portion being formed continuously on the outer periphery of the connector. Therefore, the arm body is difficult to deform by changes in temperature, etc., which means that even if tensile force is applied to both connectors, the holding portion is not subject to floating. As a result, the locked condition is not likely to be released, thus ensuring satisfactory holding of both connectors.

DETAILED DESCRIPTION OF THE PREFERRED EMBODIMENTS

Figure 1:
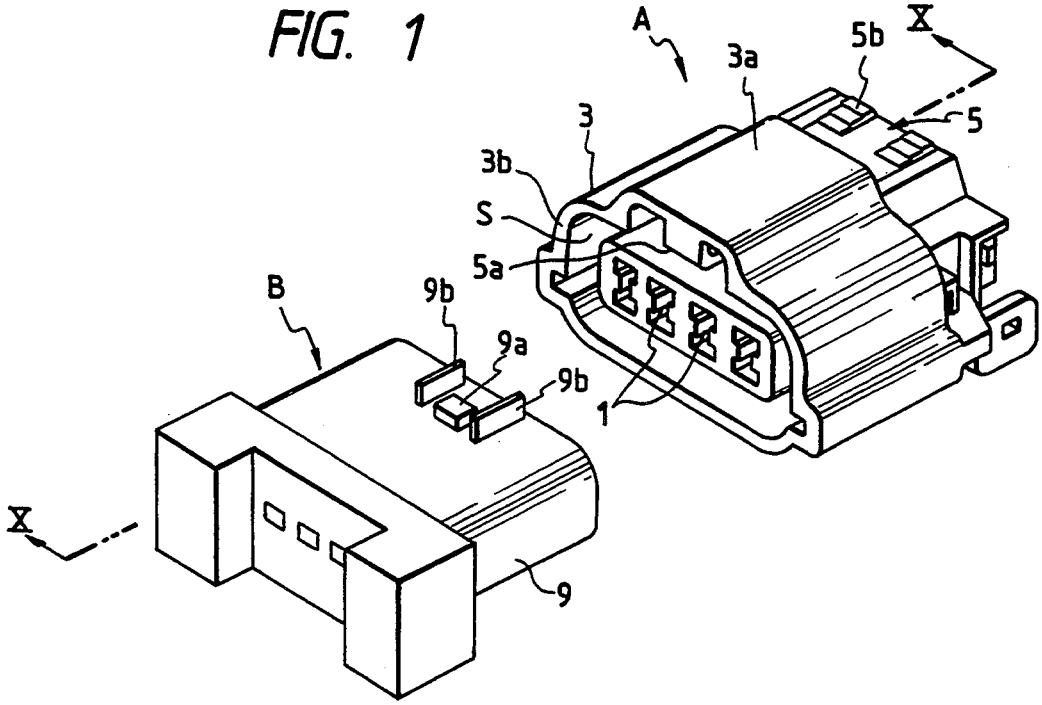
FIG. 1 is a perspective view of a connector, which is an embodiment of the invention, with a male connector being separated from a female connector.
Figure 2:
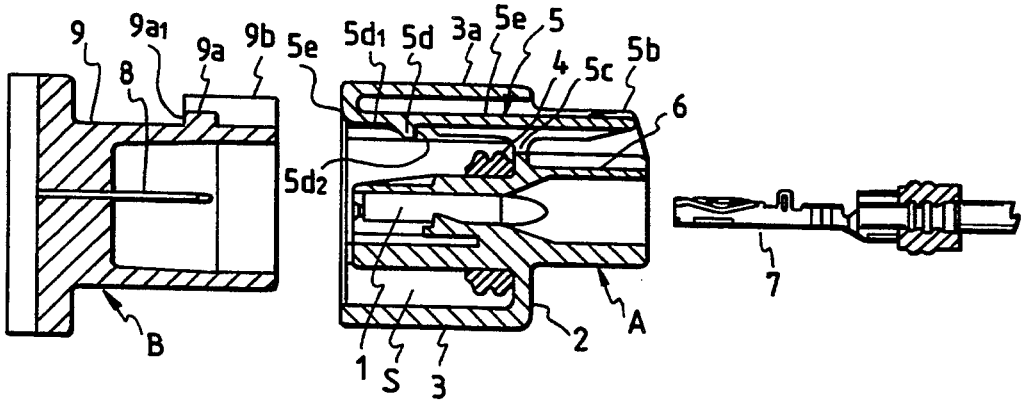
FIG. 2 is a sectional view taken along a line X—X of the male and female connectors of FIG. 1.

In FIG. 1, reference character A designates a watertight male connector having a plurality of terminal accommodating chambers 1. As shown in FIG. 2, an outer casing 3 is formed continuously on the male connector A through a coupling wall 2 on the rear. An annular space S is formed in the outer peripheral portion of the male connector A. A watertight seal ring 4 is accommodated in the annular space S.

Figure 3:
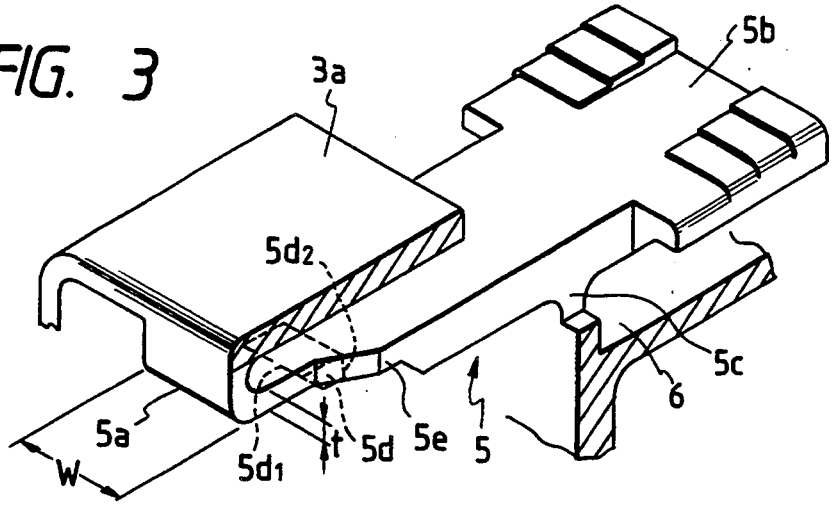
FIG. 3 is diagram illustrative of a locking arm of FIG. 2.

A bulge 3*a* is arranged on the outer casing 3. Inside the bulge 3*a* is a locking arm 5 as shown in FIG. 3 in cutaway form, the locking arm 5 being arranged so as to face the annular space S.

The locking arm 5 is so designed that an end portion of an arm body 5*e* is continuously coupled to an end portion on a female connector receiving opening portion 3*b* side through a flexible coupling portion 5*a*. The arm body 5*e* extends frontward from a rising base portion 5*c* continuously formed on an outer periphery 6 of the male connector A; and the end portion on the female connector receiving opening portion 3*b* side is arranged on the outer casing 3. A pushing section 5*b* is arranged rearward from the rising base portion 5. Reference numeral 7 designates a female terminal to be inserted into the terminal accommodating chamber 1.

The flexible coupling portion 5*a* is a flexible thin plate and is arranged so as to be substantially parallel with the outer peripheral portion of the connector. A front end portion of the flexible coupling portion 5*a* is coupled to the outer casing 3. A holding portion 5*d* for holding a female connector B extends downward toward the outer peripheral portion of the connector. The holding portion 5*d* has a tapered guide surface $5d_1$ on the front side and a vertical holding surface $5d_2$ on the rear side. By changing the width w and thickness t of the flexible coupling portion 5*a*, flexibility of the flexible coupling portion 5*a* can be changed so as to match the number of terminals and size of a connector, so that the inserting force that depends on the number of terminals of a connector can be adjusted.

On the other hand, the female connector B includes an engaging projection 9a and guide projections 9b, 9b. The engaging projection 9a has a vertical holding surface $9a_1$ corresponding to the holding portion 5d of the flexible locking arm 5, and is arranged on the outer surface of a casing body 9 accommodating a plurality of male terminals 8. The guide projections 9b, 9b are arranged on both sides of the engaging projection 9a.

Figure 4:
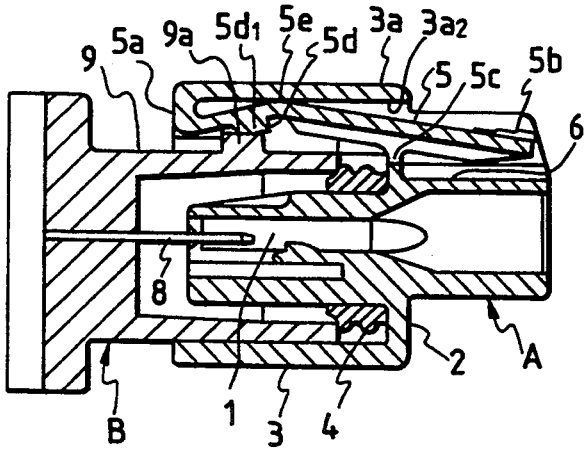
FIG. 4 is a sectional view showing an initial condition in which the male connector is fitted into the female connector of FIG. 2.

To engage the male connector A with the female connector B, the casing body 9 of the female connector B is inserted into the annular space S of the male connector A first. As the casing body 9 of the female connector B enters into the annular space S of the male connector A, the engaging projection 9a abuts against the tapered guide surface $5d_1$ of the holding portion 5d, as shown in FIG. 4, pushing the flexible coupling portion 5a upward.

Figure 5:
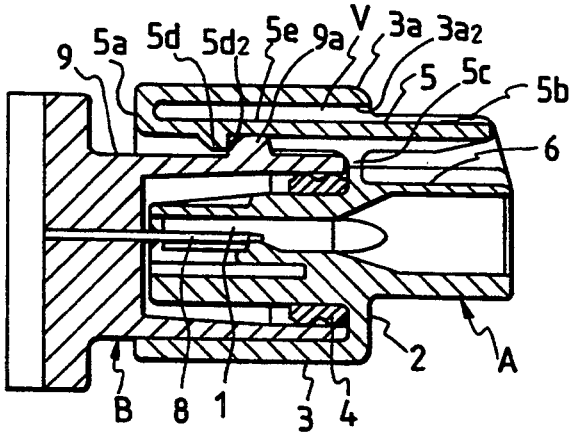
FIG. 5 is a sectional view showing a condition in which the male connector is coupled to the female connector of FIG. 2.

When the engaging projection 9a goes over the holding portion 5d while flexing the flexible coupling portion 5a, the flexible coupling portion 5a returns to the original parallel condition as shown in FIG. 5, locking the male connector A and the female connector B with the vertical holding surface $5d_2$ of the holding portion 5d abutting against the vertical holding surface $9a_1$ of the engaging projection 9a in a direction substantially orthogonal to a direction of an engaging axis. By setting a distance V between an inner wall $3a_2$ of the bulge 3a and the flexible coupling portion 5a to a proper value, excessive deformation of the flexible coupling portion 5a can be prevented.

Under this condition, not only watertightness is maintained with the casing body 9 of the female connector B being in pressure contact with the seal ring 4, but also the male terminal 8 of the female connector B is electrically connected to the female terminal 7 (see FIG. 2) inserted into the male connector.

To disengage the male connector A from the female connector B, the pushing section 5b of the locking arm 5 of the male connector A is pushed to flex the flexible coupling portion 5a in substantially convex form, so that the holding portion 5d is elevated to a position higher than the engaging projection 9a of the female connector B to thereby release the female connector B. At this time, the rising base portion 5c serves as the fulcrum of a lever, which helps the user to uncouple the female connector B easily with a small pushing force.

Figure 6:
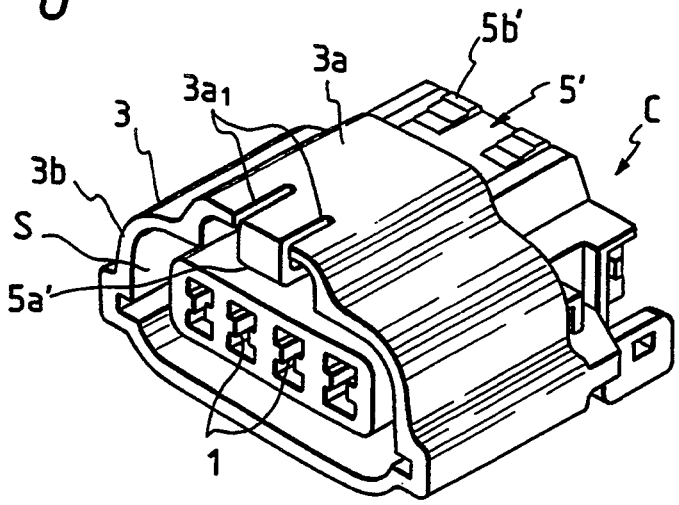
FIG. 6 is a perspective view showing another embodiment of the invention.
Figure 7:
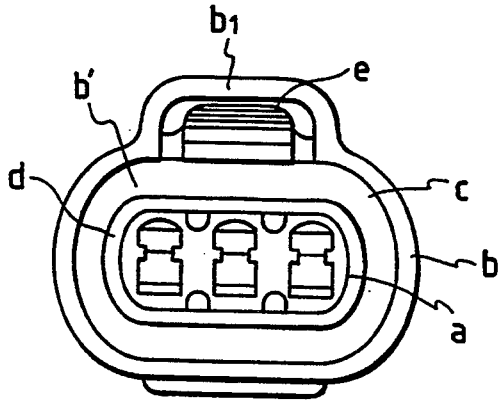
FIG. 7 PRIOR ART
FIG. 7 is a front view of a conventional male connector.
Figure 8:
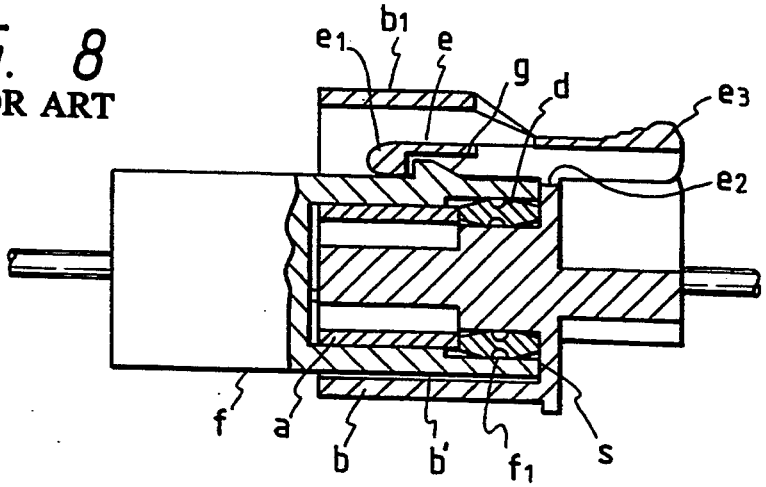
FIG. 8 PRIOR ART
FIG. 8 is a sectional view showing a condition in which the conventional male connector is coupled to a conventional female connector.

FIG. 6 is a perspective view of a male connector C, which is another embodiment of the invention.

The male connector C has slits $3a_1$ on an outer casing bulge 3a and a locking arm 5' that is formed by bending a flexible coupling portion 5a' so as to be U-shaped. Reference character 5b' designates a pushing section. The other structural aspects are the same as those of the above-described male connector A.

The male connector C is designed to change the length of the U-shaped flexible coupling portion 5a' by changing the length of the slit $3a_1$. Thus, the flexibility of the flexible coupling portion can be changed freely.

According to the invention, the front end of the arm body of the locking arm is coupled integrally to the outer casing of the connector through the flexible coupling portion, and the arm body is supported by two points, the flexible coupling portion and the rising base portion continuously formed on the outer periphery of the connector. Therefore, the arm body is hard to deform by changes in temperature. A tensile force applied to both connectors does not cause the holding portion to float, thereby not unlocking the connectors, which prevents such troubles as defective engagement and false connection. Further, the flexible coupling portion in the locking arm contributes to stabilizing the displacement of the holding portion at the time of engaging and unlocking the connectors, thereby improving the reliability in holding the connectors. Still further, the pushing section arranged on the end portion that is at the rear of the rising base portion causes the rotational support portion thereof to act as the fulcrum of a lever in the unlocking operation, thereby not only facilitating the unlocking operation by reducing the unlocking force, but also improving operability in the connector assembling process and maintenance.

What is claimed is:

1. A connector comprising:

a male connector including an engaging means and an outer casing having a portion disposed outside of said engaging means with a gap therebetween, said male connector having an annular space which is partially defined by said outer casing; and a female connector having a casing body which is inserted into the annular space, wherein said engaging means is integral to the outer casing and engages said female connector.

2. A connector as claimed in claim 1, wherein the engaging means comprises:

a locking arm including:

an arm body extending frontward through a rising base member continuously formed on an outer periphery of the male connector, the arm body having a holding member to be engaged with the female connector and;

a pushing member extending rearward through the rising base member.

3. A connector as claimed in claim 2, wherein a front end portion of the arm body is integrally coupled to the outer casing through a flexible coupling member.

4. A connector as claimed in claim 1, further comprising:

a watertight seal ring accommodated into the annular space.

5. The connector of claim 1, wherein said engaging means includes a locking arm having a distal end extending toward said female connector, said locking arm being coupled to the outer casing at the distal end of said locking arm.

6. A connector comprising:

a male connector having an annular space which is defined by arranging an outer casing at a circumferential portion of the male connector;

a female connector having a casing body which is inserted into the annular space; and engaging means for engaging the male connector and the female connector, the engaging means being integrally coupled to the outer casing, wherein said engaging means comprises a locking arm including:

an arm body extending frontward through a rising base member continuously formed on an outer periphery of the male connector, the arm body having a holding member to be engaged with the female connector; and a pushing member extending rearward through the rising base member, wherein a front end portion of the arm body is integrally coupled to the outer casing through a flexible coupling member.

* * * * *